US006935969B2

(12) United States Patent
Kumamoto

(10) Patent No.: US 6,935,969 B2
(45) Date of Patent: Aug. 30, 2005

(54) GOLF CLUB SHAFT

(75) Inventor: Tomio Kumamoto, Hyogo (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/268,839

(22) Filed: Oct. 11, 2002

(65) Prior Publication Data

US 2003/0073508 A1 Apr. 17, 2003

(30) Foreign Application Priority Data

Oct. 11, 2001 (JP) ..... 2001-314221

(51) Int. Cl.[7] ..... A63B 53/10
(52) U.S. Cl. ..... 473/319
(58) Field of Search ..... 473/319, 320, 473/321

(56) References Cited

U.S. PATENT DOCUMENTS 6,132,323 A * 10/2000 Smith et al. ..... 473/319
6,261,500 B1 * 7/2001 Park et al. ..... 264/258
6,273,830 B1 * 8/2001 Takemura et al. ..... 473/319
6,524,195 B1 * 2/2003 Kusumoto ..... 473/319

FOREIGN PATENT DOCUMENTS

| | | | |
|---|---|---|---|
| GB | 2306335 | * | 7/1997 |
| JP | 5-123428 | A | 5/1993 |
| JP | 9-216958 | A | 8/1997 |
| JP | 10-36638 | A | 2/1998 |

* cited by examiner

*Primary Examiner*—Stephen Blau
(74) *Attorney, Agent, or Firm*—Birch, Stewart, Kolasch & Birch, LLP

(57) ABSTRACT

A golf club shaft having a fiber reinforced thermosetting resinous material (10) and a fiber reinforced thermoplastic resinous material (20), wherein the fiber reinforced thermoplastic resinous material (20) having a vibration-damping factor not less than 1.0 has a weight not less than 10% nor more than 60% of a weight of the golf club shaft. The fiber reinforced thermoplastic resinous material (20) is disposed on a part of a peripheral surface of the golf club shaft, on an inner peripheral surface thereof or between layers of the fiber reinforced thermosetting resinous material (10).

11 Claims, 10 Drawing Sheets

GOLF CLUB SHAFT

BACKGROUND OF THE INVENTION

This nonprovisional application claims priority under 35 U.S.C. § 119(a) on patent application Ser. No. 2001-314221 filed in JAPAN on Oct. 11, 2001, which is herein incorporated by reference.

1. Field of the Invention

The present invention relates to a-golf club shaft and more particularly to a lightweight golf club shaft, made of a fiber reinforced resin, which has an improved vibration-damping performance.

2. Description of the Related Art

In recent years, a golf club shaft composed of a reinforcing fiber such as a carbon fiber having a high strength and a high rigidity is manufactured and commercially available. As the strength and the rigidity of the carbon fiber increase, a lightweight golf club shaft can be manufactured.

As the golf club shaft becomes more lightweight, a head speed of the golf club will increase when the club is swung. Thus, the player can hit a golf ball a longer distance with this golf club. On the other hand, as the golf club shaft becomes more lightweight, the player feels unpleasant vibrations and impacts that are generated when the player hits the golf ball with the golf club. As the golf club shaft becomes more lightweight, the frequency of the vibration thereof becomes higher than the conventional golf club shaft. Therefore in recent years, players are increasingly damaged at their elbows and shoulders by vibrations and impacts generated when they hit the golf ball with golf clubs composed of the lightweight golf club shafts.

To suppress the vibrations generated when the player hits the golf ball many proposals are made. For example, in Japanese Patent Application Laid-Open Nos.9-216958 and 10-36638, resinous particles of an ethylene copolymer and rubber particles are mixed with the resin of the fiber reinforced resin layer to form a prepreg and an epoxy resinous composition using the fiber reinforced resin superior in vibration suppression performance and resistance to impacts.

In the golf club shaft having the three-layer construction disclosed in Japanese Patent Application Laid-Open No.5-123428, to obtain vibration absorption performance and a soft feeling, the vibration suppression material layer is inserted into the layer of vibration suppression materials.

In the prepreg disclosed in Japanese Patent Application Laid-Open Nos.9-216958 and 10-36638, the prepreg itself has vibration suppression performance. However, in the case where the golf club shaft is composed of the prepeg, the prepreg is incapable of achieving dramatic vibration-damping performance to such an extent that the player can feel.

In the golf club shaft disclosed in Japanese Patent Application Laid-Open No.5-123428, it is difficult to design the golf club shaft in such a way as to flex it. Since the degree of freedom in designing the golf club is low, it is difficult make it lightweight and increase the flight distance of the golf ball while allowing the golf club shaft to have vibration-damping performance. Further it is difficult to mold the material for the golf club shaft. Thus, the golf club shaft has a problem that there is a large lot-to-lot variation in its vibration suppression function.

SUMMARY OF THE INVENTION

The present invention has been made in view of the above-described problems. Therefore, it is an object of the present invention to provide a golf club shaft that is lightweight and capable of hitting a golf ball a long distance, has sufficient strength, relieves vibrations and impacts that are transmitted to a player to allow the player to feel that the golf club shaft is softer than the conventional golf club shaft when the player hits a golf ball with a golf club composed of the golf club shaft.

To achieve the object, according to the present invention, there is provided a golf club shaft having a fiber reinforced thermosetting resinous material and a fiber reinforced thermoplastic resinous material, wherein the fiber reinforced thermoplastic resinous material having a vibration-damping factor not less than 1.0 has a weight not less than 10% nor more than 60% of a weight of the golf club shaft.

The golf club shaft of the present invention is formed in combination of the fiber reinforced thermosetting resinous material and the fiber reinforced thermoplastic resinous material whose vibration-damping factor is set to not less than 1.0 and whose weight is also set to the above-described range. Therefore the shaft is lightweight and capable of keeping the balance between a high strength of the fiber reinforced thermosetting resinous material and a high vibration-damping performance of the vibration-damping factor-specified fiber reinforced thermoplastic resinous material. That is, utilizing the advantage of the fiber reinforced thermosetting resinous material and that of the fiber reinforced thermoplastic resinous material, the shaft which is lightweight and has a high strength and rigidity is capable of giving a mild feeling to a player when the player hits a golf ball. Therefore, the shaft is capable of suppressing vibrations and impacts to be transmitted to the player when the player hits the golf ball with a golf club composed of the shaft. That is, the golf club shaft of the present invention gives a good feeling to the player when the player hits the golf ball with the golf club composed of the shaft.

In the golf club shaft of the present invention, the weight of the fiber reinforced thermoplastic resinous material whose vibration-damping factor is not less than 1.0 is specified as above is for the following reason: If the vibration-damping factor of the weight-specified fiber reinforced thermoplastic resinous material is less than 1.0, the shaft is incapable of sufficiently displaying its vibration-damping effect. That is, the shaft is incapable of relieving vibrations and impacts to be transmitted to the player when the player hits the golf ball with the golf club composed of the shaft, thus giving an unpleasant feeling to the player. The vibration-damping factor of the fiber reinforced thermoplastic resinous material is favorably not less than 1.0 nor more than 2.0. To set the vibration-damping factor of the fiber reinforced thermoplastic resinous material to more than 2.0, it is necessary to increase the weight of the fiber reinforced thermoplastic resinous material. In this case, the degree of freedom in designing the weight of the shaft is liable to be low and in addition the strength thereof is liable to be low due to increase of water contained in the resin.

The vibration-damping factor of the fiber reinforced thermosetting resinous material is not specified but the vibration-damping factor of the fiber reinforced thermoplastic resinous material is specified for the reason described below: To form the fiber reinforced thermosetting resinous material having the vibration-damping factor not less than 1.0, the fiber reinforced thermosetting resinous material is obtained in an unhardened state. Thus, the fiber reinforced thermosetting resinous material has an insufficient strength.

The vibration-damping factor of the fiber reinforced thermoplastic resinous material is not less than 1.0 refers to when the vibration-damping factor thereof is measured in the same state as that in which the fiber reinforced thermoplastic resinous material is contained in the shaft. It is possible to mold the fiber reinforced thermoplastic resinous material into various shapes, e.g., pipe-shaped, semicylindrical, rod-shaped, sheet-shaped, and the like. The vibration-damping factor of the fiber reinforced thermoplastic resinous material is measured by a method, similar to that of measuring the shaft, which will be described later. The vibration-damping factor of the fiber reinforced thermoplastic resinous material is affected to the highest extent by the kind of resin. In addition, the vibration-damping factor of the fiber reinforced thermoplastic resinous material is affected by the form of a reinforcing fiber. It is most favorable to weave the reinforcing fiber in braids as its fibrous form.

The weight of the fiber reinforced thermoplastic resinous material having the vibration-damping factor not less than 1.0 is not less than 10% nor more than 60% of the weight of the entire shaft, favorably not less than 15% nor more than 40% of the weight thereof, and more favorably not less than 20% nor more than 30% of the weight thereof.

If the weight of the fiber reinforced thermoplastic resinous material is less than 10% of the weight of the entire shaft, the shaft has a low vibration-damping performance. Thus, the shaft has a low effect of suppressing vibrations to be transmitted to a player when the player hits a golf ball with a golf club composed of the shaft. On the other hand, if the weight of the fiber reinforced thermoplastic resinous material is more than 60% of the weight of the entire shaft, the vibration-damping performance of the shaft is so high that the shaft gives a player a bad feeling when the player hits the golf ball with the golf club and the shaft has a low strength.

The golf club shaft may consist of the fiber reinforced thermosetting resinous material and the fiber reinforced thermoplastic resinous material having the vibration-damping factor not less than 1.0. The golf club shaft may be formed in combination of the fiber reinforced thermosetting resinous material, the fiber reinforced thermoplastic resinous material having the vibration-damping factor not less than 1.0, and the fiber reinforced thermoplastic resinous material having the vibration-damping factor less than 1.0. The golf club shaft may contain other materials in addition to the fiber reinforced thermosetting resinous material and the fiber reinforced thermoplastic resinous material.

It is preferable that the golf club shaft is pipe-shaped and has a hollow portion; and the fiber reinforced thermoplastic resinous material (hereinafter referred to as thermoplastic FRP) is disposed on a part of a peripheral surface of the golf club shaft, on an inner peripheral surface thereof or between layers of the fiber reinforced thermosetting resinous material (hereinafter referred to as thermosetting FRP).

As described above, the thermoplastic FRP can be disposed at various positions and in various constructions. In view of the strength of the shaft, it is preferable to dispose the thermoplastic FRP at the inner peripheral side of the shaft or between layers of the thermosetting FRP. If an interface between the thermoplastic FRP and the thermosetting FRP is present on an outer layer of the shaft, the interface causes the strength of the shaft to be low.

In consideration of moldability, it is preferable that the thermosetting FRP is formed as a sheet-shaped prepreg containing thermoplastic resin as its matrix resin. It is preferable that the shaft is pipe-shaped and a laminate of prepregs. It is possible to mold the thermoplastic FRP into various shapes, e.g., pipe-shaped, semicylindrical, rod-shaped, sheet-shaped, and the like and dispose the thermoplastic FRP between prepreg sheet layers of a laminate of the thermosetting FRP or on the outer or inner surface thereof.

In forming the shaft of the thermoplastic FRP and the thermosetting FRP, they may be molded after they are integrated with each other and then hardened. Otherwise, after they are separately molded, they are bonded to each other with an adhesive agent. They may be disposed in the shaft by scattering them at a plurality of portions.

It is preferable to polish the surface of the thermoplastic FRP before the thermoplastic FRP and the thermosetting FRP contact each other. Thereby, when the thermosetting FRP is in a softened state, it flows onto a roughened surface of the thermoplastic FRP and is hardened thereafter. Thus, an anchor effect is generated to prevent separation or destruction of the contact surface of each of the thermoplastic FRP and the thermosetting FRP.

In consideration of the vibration-damping performance and balance of the shaft, it is preferable to dispose the thermoplastic FRP in the shaft entirely circumferentially. But the thermoplastic FRP may be disposed partly, e.g., ⅓, ¼ or intermittently at a plurality of positions.

The thermoplastic FRP may be disposed in the shaft entirely, partly or intermittently at a plurality of portions in the longitudinal direction of the shaft. It is favorable to dispose the thermoplastic FRP at one or more portions in the range between a position corresponding to 70% and a position corresponding to 100% of the whole length of the shaft from its tip. By disposing the thermoplastic FRP in the vicinity of the grip-mounting portion of the shaft, it is possible to give a good feeling to a player when the player hits a golf ball. It is more favorable to dispose the thermoplastic FRP at least one portion in the range between a position corresponding to 80% and the position corresponding to 100% of the whole length of the shaft from its tip. The entire grip-mounting portion of the shaft may be formed of the thermoplastic FRP, while the head-mounting portion of the shaft may be formed of the thermosetting FRP.

The thickness (length in the thickness direction of shaft) of the thermoplastic FRP is not less than 0.2 mm nor more than 0.8 mm and favorably not less than 0.3 mm nor more than 0.6 mm. The thermoplastic FRP may be present at a plurality of portions (a plurality of sheets) in the form of a prepreg in the thickness direction of shaft.

If the thickness of the thermoplastic FRP is less than 0.2 mm, the vibration-damping performance of the shaft will be low. On the other hand, if the thickness of the thermoplastic FRP is more than 0.8 mm, the shaft is so heavy that the player has difficulty in swinging a golf club composed of the shaft.

Four methods of molding the thermoplastic FRP and the thermosetting FRP in forming the shaft are described below.

Molding Method (1)

The thermoplastic FRP is injection-molded beforehand in the shape of a pipe, and is inserted between prepregs of the thermosetting FRP. This method allows the shaft to secure a high strength.

Molding Method (2)

The thermoplastic FRP is injection-molded beforehand in the shape of a pipe, and is disposed on the peripheral side of the thermosetting FRP as the outermost layer of the shaft. The shaft produced by this method visually appeals to users.

Molding Method (3)

Prepregs of the thermosetting FRP are wound around the thermoplastic FRP injection-molded beforehand to form the shaft by integral molding. Since this method allows the preformed thermosetting FRP to be molded as a mandrel, the method is superior in moldability.

Molding Method (4)

After the thermosetting FRP and the thermoplastic FRP are separately molded in the shape of pipe, the pipe made of thermoplastic FRP is bonded to the inner peripheral side of the pipe made of thermosetting FRP with an adhesive agent. In this method, it is easy to dispose the thermoplastic FRP at a desired portion of the shaft.

The weight of the shaft is set to not less than 40 g nor more than 80 g, and favorably not less than 45 g nor more than 65 g.

If the weight of the shaft is set to less than 40 g, the shaft has an insufficient strength and is liable to break. On the other hand, if the weight of the shaft is more than 80 g, the shaft is so heavy that the player has difficulty in swinging the golf club composed of the shaft and thus cannot hit the golf ball a long distance.

The length of the shaft is set to not less than 500 mm nor more than 1270 mm, and favorably not less than 900 mm nor more than 1168 mm.

If the length of the shaft is set to less than 500 mm, the shaft is so short that the player cannot swing the golf club composed of the shaft at a sufficient speed and thus cannot hit the golf ball a long distance. On the other hand, if the length of the shaft is longer than 1270 mm, the shaft is so long and heavy that the player has difficulty in swinging the golf club composed of the shaft and has a bad feeling for the golf club.

As the thermosetting resin, epoxy resin is particularly favorable in consideration of strength and rigidity. In addition, the following resins can be used singly or in combination: unsaturated polyester resin (vinyl ester resin), phenol resin, melamine resin, urea resin, diallyl phthalate resin, polyurethane resin, polyimide resin, and silicon resin.

As the thermoplastic resin, polyamide resin such as nylon 6 and nylon 12 is preferable in its superior moldability. In addition, the following resins can be used singly or in combination: saturated polyester resin, polycarbonate resin, ABS resin, polyvinyl chloride resin, polyacetal resin, polystyrene resin, polyethylene resin, polyvinyl acetate, AS resin, methacrylate resin, polypropylene resin, and fluorine resin.

As reinforcing fibers for use in the fiber reinforced resin, fibers which are used as high-performance reinforcing fibers can be used. Carbon fiber is particularly preferable because it is lightweight and has a high strength. In addition to the carbon fiber, it is possible to use glass fiber, graphite fiber, aramid fiber, silicon carbide fiber, alumina fiber, boron fiber, aromatic polyamide fiber, aromatic polyester fiber, ultra-high-molecular-weight polyethylene fiber, and the like.

These reinforcing fibers can be used in the form of long or short fibers. A mixture of two or more of these reinforcing fibers may be used. The configuration and arrangement of the reinforcing fibers are not limited to specific ones. For example, they may be arranged in a single direction or a random direction. The reinforcing fibers may have the shape of a sheet, a mat, fabrics (cloth), braids, and the like.

It is particularly preferable to weave the thermoplastic FRP in braids. Thereby the thermoplastic FRP moves easily in molding it in the shape of a pipe, and is thus highly moldable, and further its vibration-damping performance can be enhanced. The thermoplastic FRP can be preferably used by weaving it in a cross pattern.

It is preferable to form the thermosetting FRP as a sheet-shaped prepreg. Thereby the thermosetting FRP can be wound around a mandrel (iron core) easily in molding it the degree of freedom and is thus highly moldable and further the degree of freedom in designing the shaft can be increased.

The golf club shaft of the present invention is applicable to all kinds of golf clubs, for example, a wooden club, an iron club, and a putter.

DETAILED DESCRIPTION OF THE PREFERRED EMBODIMENTS

The embodiments of the present invention will be described below with reference to drawings.

Figure 1:
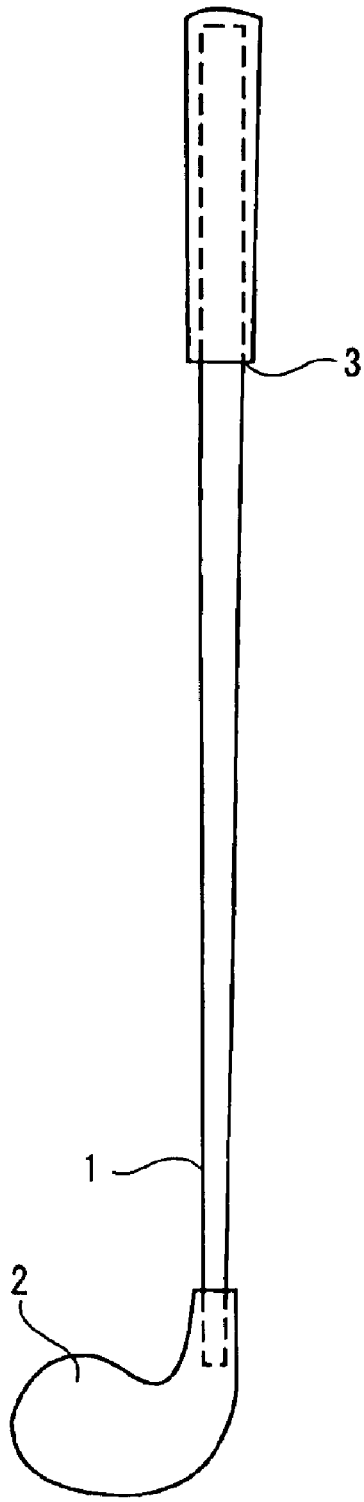
FIG. 1 is a schematic view showing a golf club using the golf club shaft according to the present invention.
Figure 2A:
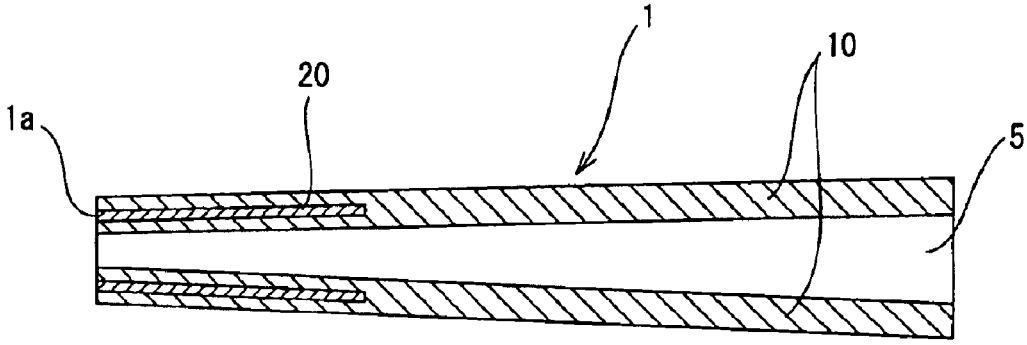
FIG. 2A is a sectional view showing a shaft of a first embodiment in an axial direction thereof.
Figure 2B:
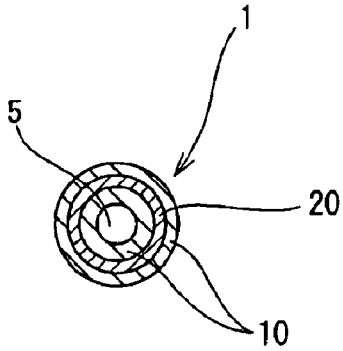
FIG. 2B is a sectional view showing the shaft in a direction perpendicular to the axial direction thereof.
Figure 3:
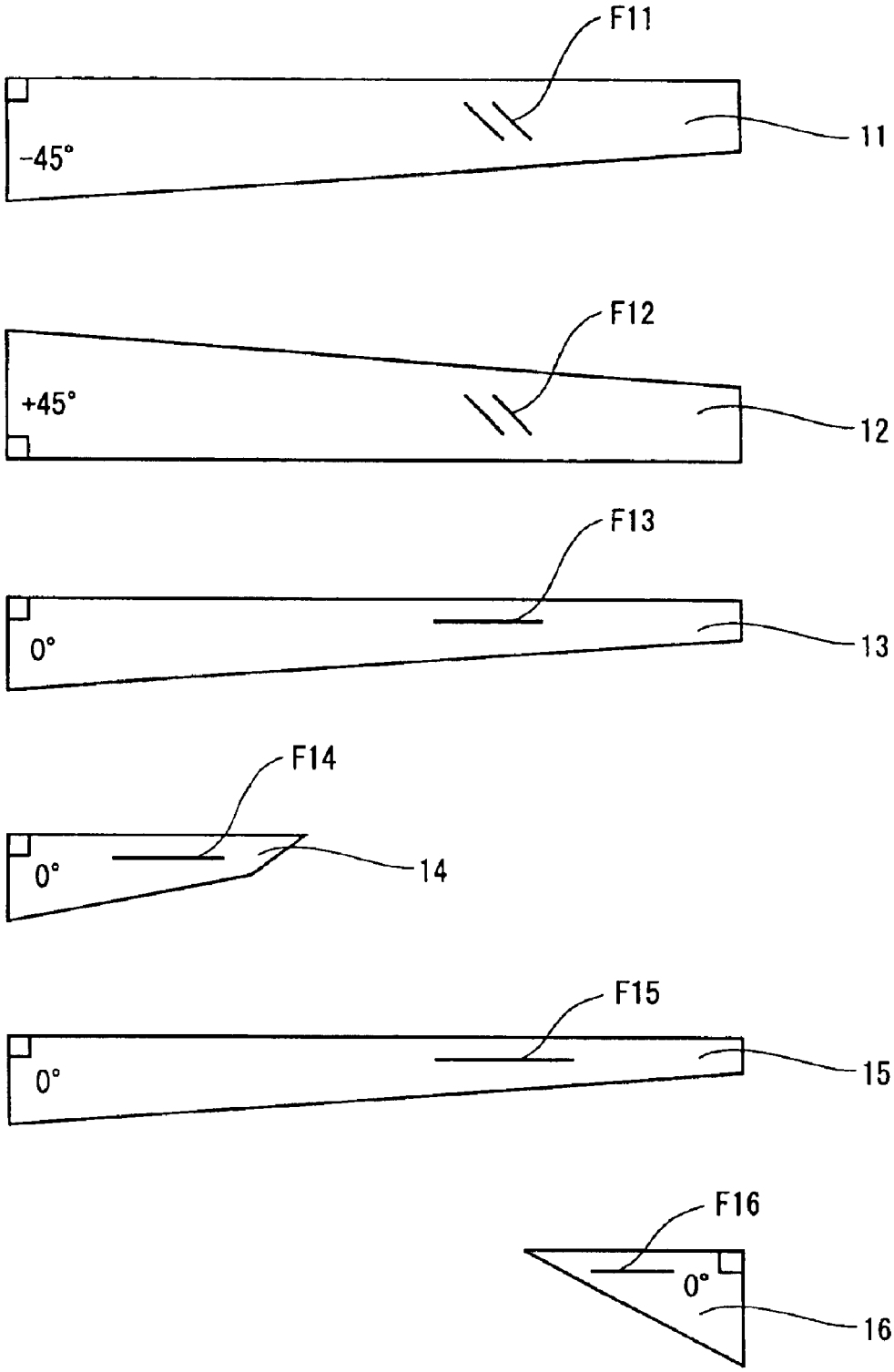
FIG. 3 shows a layering construction of prepregs.

FIGS. 1 through 3 show a golf club shaft (hereinafter referred to as merely "shaft") according to a first embodiment of the present invention. A head 2 is installed on the shaft 1 at one end thereof having a smaller diameter. A grip 3 is installed on the shaft 1 at the other end thereof having a larger diameter.

The shaft 1 has the shape of a pipe having a hollow portion 5. The shaft 1 is composed of a fiber reinforced thermosetting resinous material 10 and a fiber reinforced thermoplastic resinous material 20. The vibration-damping factor of the fiber reinforced thermoplastic resinous material 20 is 1.2. The weight of the fiber reinforced thermoplastic resinous material 20 is 25% of that of the shaft 1.

As shown in FIG. 2A, the fiber reinforced thermoplastic resinous material 20 is disposed in the range covering 30% of the whole length of the shaft 1 from the tip (head side) la thereof. In this range, the fiber reinforced thermoplastic resinous material 20 is inserted between an inner peripheral part of the fiber reinforced thermosetting resinous material 10 and a peripheral part thereof in the thickness direction of the shaft 1. As shown in FIG. 2B, the fiber reinforced thermoplastic resinous material 20 is disposed entirely in the circumferential direction of the shaft 1.

The fiber reinforced thermoplastic resinous material 20 is formed by weaving carbon fibers serving as the reinforcing fiber thereof into braids and injection-molding a mixture of the carbon fiber, nylon 6, and a hardening agent by means of a pipe-shaped mold so that the mixture undergoes a reaction and hardens into a required configuration.

The fiber reinforced thermosetting resinous material 10 is a laminate of prepregs 11–16, as shown in FIG. 3.

In the fiber reinforced prepregs 11 and 12, reinforcing fibers F11 and F12 have a tensile modulus of elasticity of 40 ton f/mm$^2$ respectively and orientation angles of +45° and −45° (angular layer) respectively with respect to the axis of the shaft 1.

In the fiber reinforced prepreg 13, a reinforcing fiber F13 has a tensile modulus of elasticity of 30 ton f/mm$^2$ and an orientation angle of 0° (straight layer) with respect to the axis of the shaft 1.

In the fiber reinforced prepreg 14, a reinforcing fiber F14 has a tensile modulus of elasticity of 80 ton f/mm$^2$ and an orientation angle of 0° with respect to the axis of the shaft 1. The fiber reinforced prepreg 14 is disposed at the grip side of the shaft 1 as a reinforcing layer.

In the fiber reinforced prepreg 15, a reinforcing fiber F15 has a tensile modulus of elasticity of 30 ton f/mm$^2$ and an orientation angle of 0° with respect to the axis of the shaft 1.

In the fiber reinforced prepreg 16, a reinforcing fiber F16 has a tensile modulus of elasticity of 10 ton f/mm$^2$ and an orientation angle of 0° with respect to the axis of the shaft 1. The fiber reinforced prepreg 16 is disposed at the head side of the shaft 1 as a reinforcing layer.

The reinforcing fibers F11 through F16 consist of carbon fibers respectively. Epoxy resin is used as the matrix resin of each of the prepregs.

The shaft 1 is formed as follows:

After the fiber reinforced prepregs 11 and 12 are layered on each other and wound around a core metal (mandrel), the prepreg 13 is wound around the lamination of the fiber reinforced prepregs 11 and 12. The pipe-shaped fiber reinforced thermoplastic resinous material 20 molded as described above is disposed on the peripheral layer of the lamination in the range covering 30% of the whole length of the shaft 1 from the tip 1*a* thereof. Then the prepreg 14 is wound around the lamination at its grip side. Then the prepreg 15 is wound around the lamination. Thereafter the prepreg 16 is wound around the lamination at its head side. A tape made of polyethylene terephthalate is lapped around the laminate. Then integral molding is performed. That is, the laminate is heated in an oven under a pressure to harden the resin. Thereafter the mandrel is drawn from the lamination to form the shaft 1 (molding method (1)). In this manner, the fiber reinforced thermoplastic resinous material 20 is inserted between the prepregs 13 and 15 at the head side thereof.

As described above, the shaft 1 is the lamination of the weight-specified fiber reinforced thermoplastic resinous material 20 having the vibration-damping factor of not less than 1.0 and the fiber reinforced thermosetting resinous material 10. Therefore the shaft 1 is lightweight and capable of keeping the balance between a high strength of the fiber reinforced thermosetting resinous material 10 and a high vibration-damping performance of the vibration-damping factor-specified fiber reinforced thermoplastic resinous material 20. That is, utilizing the advantage of the fiber reinforced thermosetting resinous material 10 and that of the fiber reinforced thermoplastic resinous material 20, it is possible to allow the shaft 1 to be lightweight and have high strength and rigidity to give a favorable feeling to a player when the player hits a golf ball with a golf club composed of the shaft 1. That is, the shaft 1 is capable of suppressing vibrations from impacts to be transmitted to the player when the player hits the golf ball with the golf club composed of the shaft 1.

Figure 4A:
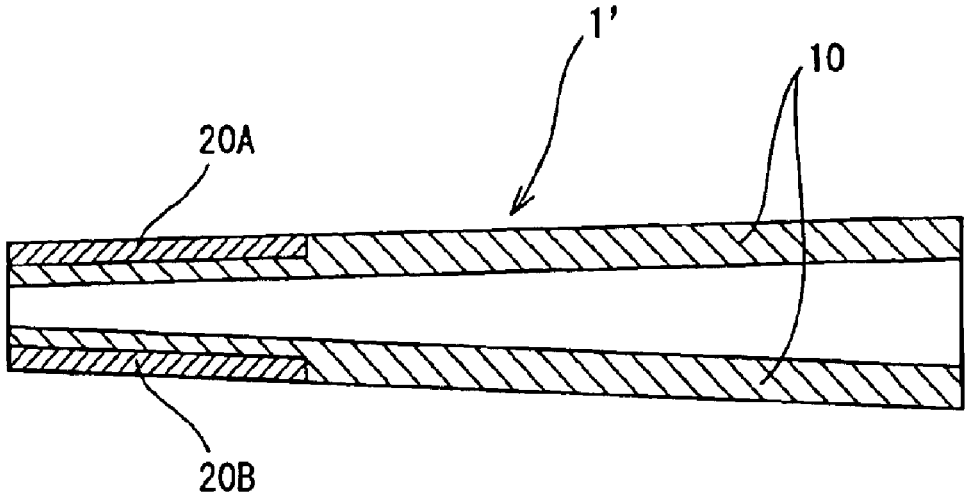
FIG. 4A is a sectional view showing a shaft of a second embodiment in an axial direction thereof.
Figure 4B:
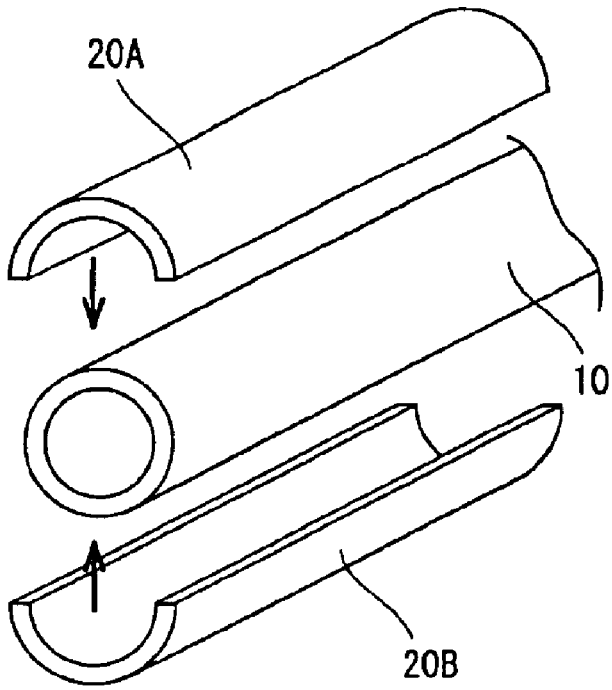
FIG. 4B shows a method of molding the shaft of the second embodiment.

As shown in FIGS. 4A and 5B, a shaft 1' of a second embodiment may be formed by dividing the fiber reinforced thermoplastic resinous material 20 molded in advance in the shape of a pipe into two semicylinders 20A and 20B and disposing the fiber reinforced thermoplastic resinous materials 20A and 20B on the outer peripheral surface of the fiber reinforced thermosetting resinous material 10 in the range covering 30% of the whole length of the shaft 1 from the tip thereof. More specifically, after the fiber reinforced thermosetting resinous material 10 is molded separately from the fiber reinforced thermoplastic resinous materials 20A and 20B, the fiber reinforced thermosetting resinous material 10 mold into the shape of the pipe is bonded to the fiber reinforced thermoplastic resinous materials 20A and 20B with an adhesive agent (molding method (2)).

Figure 5:
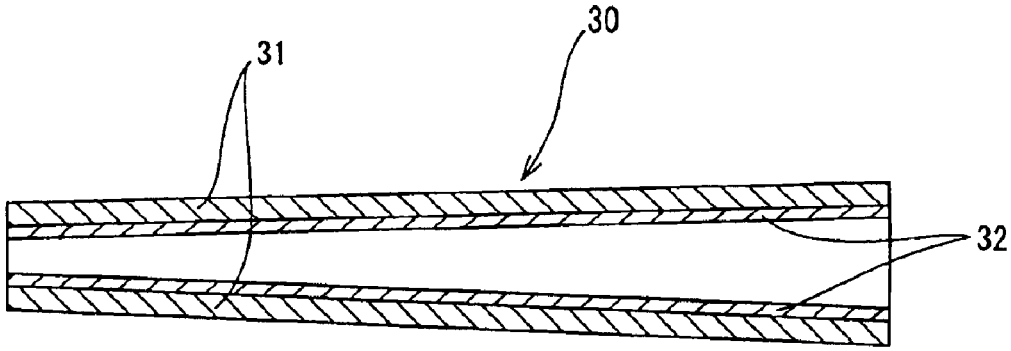
FIG. 5 is a sectional view showing a shaft of a third embodiment in an axial direction thereof.

FIG. 5 shows a shaft 30 of a third embodiment. A fiber reinforced thermoplastic resinous material 32 is disposed on the inner peripheral side of the pipe-shaped shaft 30 in the range from its tip to its butt. More specifically, the pipe-shaped fiber reinforced thermoplastic resinous material 32 tapered at the same inclination rate as that of a mandrel is molded beforehand over the whole length of the shaft 30 by injection molding. Thereafter, prepregs of fiber reinforced thermosetting resinous material 31 are layered on the fiber reinforced thermoplastic resinous material 32 by winding the former around the latter to form the shaft 30 by integral molding (molding method (3)). As another method of forming the shaft, after a fiber reinforced thermoplastic resinous material whose inner configuration conforms to the outer configuration of a mandrel is molded, the molded fiber reinforced thermoplastic resinous material is mounted on the mandrel. After prepregs of a fiber reinforced thermosetting resinous material are layered on the molded fiber reinforced thermoplastic resinous material by winding the former on the latter, both are integrally molded to form a laminate. Thereafter, the molded laminate is drawn out from the mandrel.

Figure 6A:
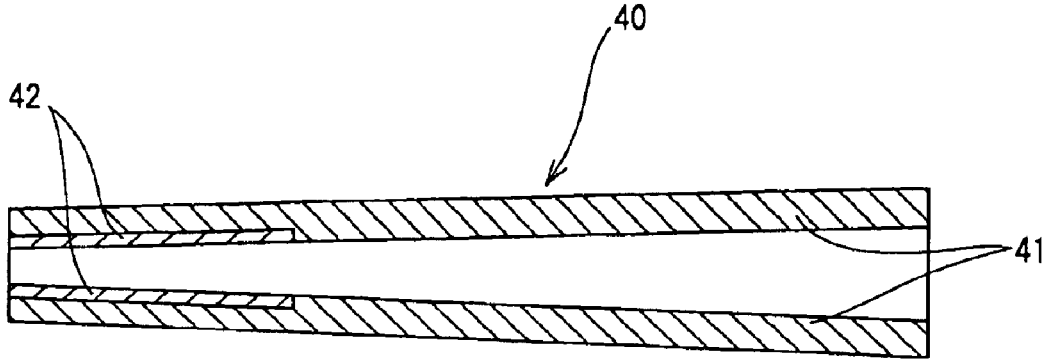
FIG. 6A is a sectional view showing a shaft of a fourth embodiment in an axial direction thereof.
Figure 6B:
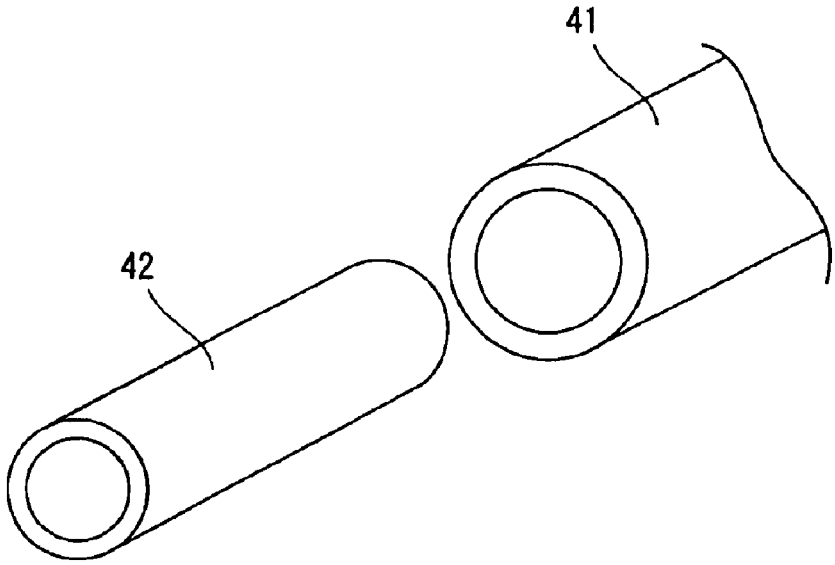
FIG. 6B shows a method of molding the shaft of the fourth embodiment.

FIGS. 6A and 6B show a shaft 40 of a fourth embodiment. After a fiber reinforced thermoplastic resinous material 42 and a fiber reinforced thermosetting resinous material 41 are molded separately, both are joined with each other with an adhesive agent. Thereafter, the fiber reinforced thermoplastic resinous material 42 is disposed on the inner peripheral side of the shaft 40 in the range covering 30% of the whole length thereof from its tip. More specifically, the fiber reinforced thermoplastic resinous material 42 is molded in the shape of a pipe in advance by injection molding in conformity to the configuration of the inner peripheral side of the shaft 40. The mandrel is adjusted to a desired configuration. Then prepregs are wound around the mandrel to mold the fiber reinforced thermosetting resinous material 41. Thereafter, the fiber reinforced thermoplastic resinous material 42 is bonded to the inner peripheral surface of the fiber reinforced thermosetting resinous material 41 with an adhesive agent (molding method (4)).

Figure 7:
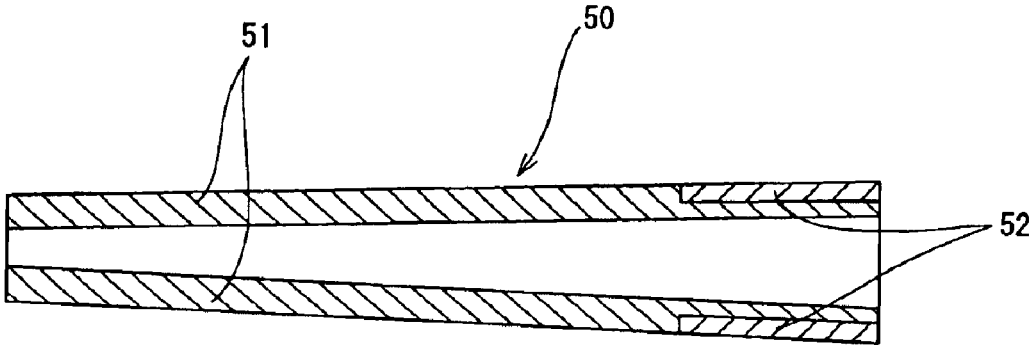
FIG. 7 is a sectional view showing a shaft of a fifth embodiment in an axial direction thereof.

FIG. 7 shows a shaft 50 of a fifth embodiment. The outer side of a grip-mounting portion of the shaft 50 is composed of a fiber reinforced thermoplastic resinous material 52. Portions of the shaft 50 other than the grip-mounting portion are formed of a fiber reinforced thermosetting resinous material 51.

Figure 8:
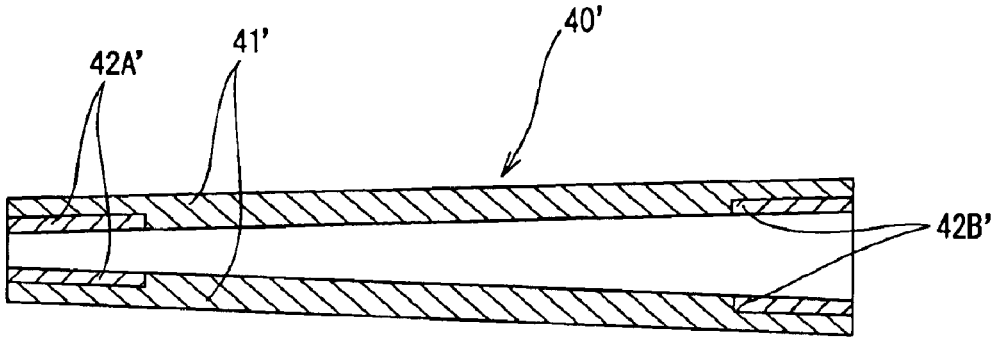
FIG. 8 is a sectional view showing a shaft of a modification of the fourth embodiment in an axial direction thereof.

As shown in FIG. 8, a shaft 40' can be formed of a fiber reinforced thermosetting resinous material 41' and fiber reinforced thermoplastic resinous materials 42A' and 42B' disposed on the inner peripheral side of the head and the grip of the shaft 40' respectively.

Figure 9:
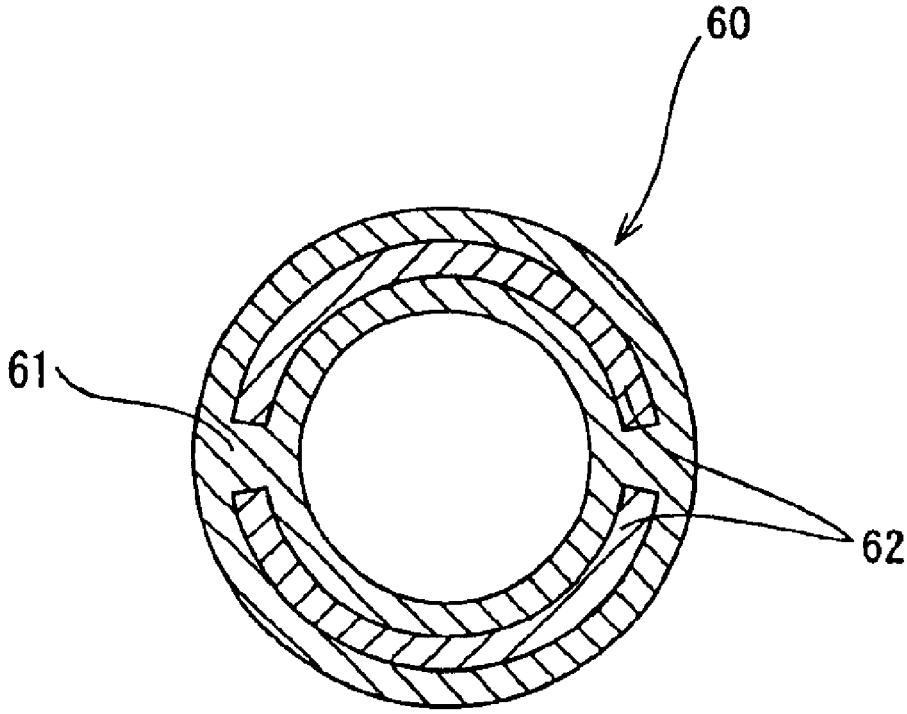
FIG. 9 is a sectional view showing another form of the shaft of the present invention.

As shown in FIG. 9, a shaft 60 can be composed of a fiber reinforced thermoplastic resinous material 62 and a fiber reinforced thermosetting resinous material 61 by disposing the fiber reinforced thermoplastic resinous material 62 not entirely in the circumferential direction of the shaft 60. The fiber reinforced thermoplastic resinous material can be also formed as a lamination of prepregs. As described above, the shaft can be formed by carrying out various molding methods and by disposing the fiber reinforced thermoplastic resinous material at various positions of the shaft.

The golf club shaft of each of the Examples and the Comparison Examples will be described in detail below.

The vibration-damping factor of the thermoplastic FRP, the percentage of the weight of the thermoplastic FRP to the weight of the shaft, the method of molding the shaft, and the placed position of the thermoplastic FRP were set as shown in Table 1. Using the thermoplastic FRP and the thermosetting FRP, a golf club shaft of each of the examples and the comparison examples was prepared.

TABLE 1

| | CE1 | CE2 | CE3 | E1 | E2 | E3 | E4 | E5 | E6 |
|---|---|---|---|---|---|---|---|---|---|
| vibration damping factor of thermoplastic FRP | 0.7 | 1.2 | 1.2 | 1.2 | 1.2 | 1.2 | 1.2 | 1.2 | 1.2 |
| percentage of weight of thermoplastic FRP to weight of shaft | 25% | 5% | 70% | 25% | 25% | 25% | 25% | 45% | 35% |
| method of molding shaft | ① | ① | ① | ① | ① | ② | ② | ③ | ④ |
| position of thermoplastic FRP (percentage to whole length of shaft from tip) | 0%~30% | 0%~30% | 0%~30% | 0%~30% | 50%~80% | 0%~30% | 30%~50% | 0%~100% | 0%~30% |
| vibration-damping factor of shaft | 0.52 | 0.50 | 1.50 | 0.91 | 0.91 | 0.85 | 0.84 | 1.00 | 0.80 |
| feeling test | Δ | X | ◎ | ○ | ◎ | ○ | ○ | ◎ | ○ |
| durability test | ○ | ○ | X | ○ | ○ | ○ | ○ | ○ | ○ |

where "CE" denotes comparison example.
where "E" denotes example.

EXAMPLE 1

The shaft of Example 1 had the same construction as the first embodiment. The specification of the shaft was set as shown in Table 1.

EXAMPLE 2

The shaft of Example 2 had a mode similar to that of Example 1 except the position of the fiber reinforced thermoplastic resinous material was changed. A mandrel and a prepreg were appropriately adjusted and the specification of the shaft was set as shown in Table 1.

EXAMPLE 3

The shaft of Example 3 had the same construction as the second embodiment. A mandrel and a prepreg were appropriately adjusted, and the specification of the shaft was set as shown in Table 1.

EXAMPLE 4

The shaft of Example 4 had a mode similar to that of Example 3 except the position of the fiber reinforced thermoplastic resinous material. A mandrel and a prepreg were appropriately adjusted, and the specification of the shaft was set as shown in Table 1.

EXAMPLE 5

The shaft of Example 5 had the same construction as the third embodiment. A mandrel and a prepreg were appropriately adjusted, and the specification of the shaft was set as shown in Table 1.

EXAMPLE 6

The shaft of Example 6 had the same construction as the fourth embodiment. A mandrel and a prepreg were appropriately adjusted, and the specification of the shaft was set as shown in Table 1.

COMPARISON EXAMPLE 1

Except that polyphenylene sulfide was used as the thermoplastic resin, the specification of the shaft of Comparison Example 1 was similar to that of Example 1.

COMPARISON EXAMPLE 2

Except that the percentage of the weight of the fiber reinforced thermoplastic resinous material to that of the entire weight of the shaft was set to five, the shaft of Comparison Example 2 had a mode similar to that of Example 1. A mandrel and a prepreg were appropriately adjusted, and the specification of the shaft was set as shown in Table 1.

COMPARISON EXAMPLE 3

Except that the percentage of the weight of the fiber reinforced thermoplastic resinous material to that of the entire weight of the shaft was set to 70, the shaft of Comparison Example 2 had a mode similar to that of Example 1. A mandrel and a prepreg were appropriately adjusted, and the specification of the shaft was set as shown in Table 1.

In Examples 1 through 6 and Comparison Examples 2 and 3, as the reinforcing fiber of the fiber reinforced thermoplastic resinous material, carbon fiber T-700 produced by Toray industries, Inc. was used. The carbon fiber T-700 was woven in braids. In Comparison Example 1, the carbon fiber was sheet-shaped. Except in Comparison Example 1, as the matrix resin, nylon 6 that is polyamide resin was used.

In the Examples and the Comparison Examples, the fiber reinforced thermoplastic resinous material was formed as a lamination of prepregs similarly to Example 1. As the reinforcing fiber having the tensile modulus of elasticity of 30 ton f/mm$^2$, MR40 produced by Mitsubishi Rayon Kabushiki Kaisha and T800H produced by Toray industries, Inc. were used. A s the carbon fiber having the tensile modulus of elasticity of 40 ton f/mm$^2$, HRX series (HR40) produced by Mitsubishi Rayon Kabushiki Kaisha and M40J produced by Toray industries, Inc. were used. As the carbon fiber having the tensile modulus of elasticity of 80 ton f/mm$^2$, YS-80 produced by Nippon Graphite Kabushiki Kaisha was used. As the carbon fiber having the tensile modulus of elasticity of 10 ton f/mm$^2$, NX-10 produced by Nippon Graphite Kabushiki Kaisha was used.

Evaluation of the vibration-damping performance, feeling, and durability of each of Examples and the Comparison Examples was made by the methods described later. Table 1 shows the results of these evaluations.

Method of Measuring Vibration-Damping Performance

Figure 10:
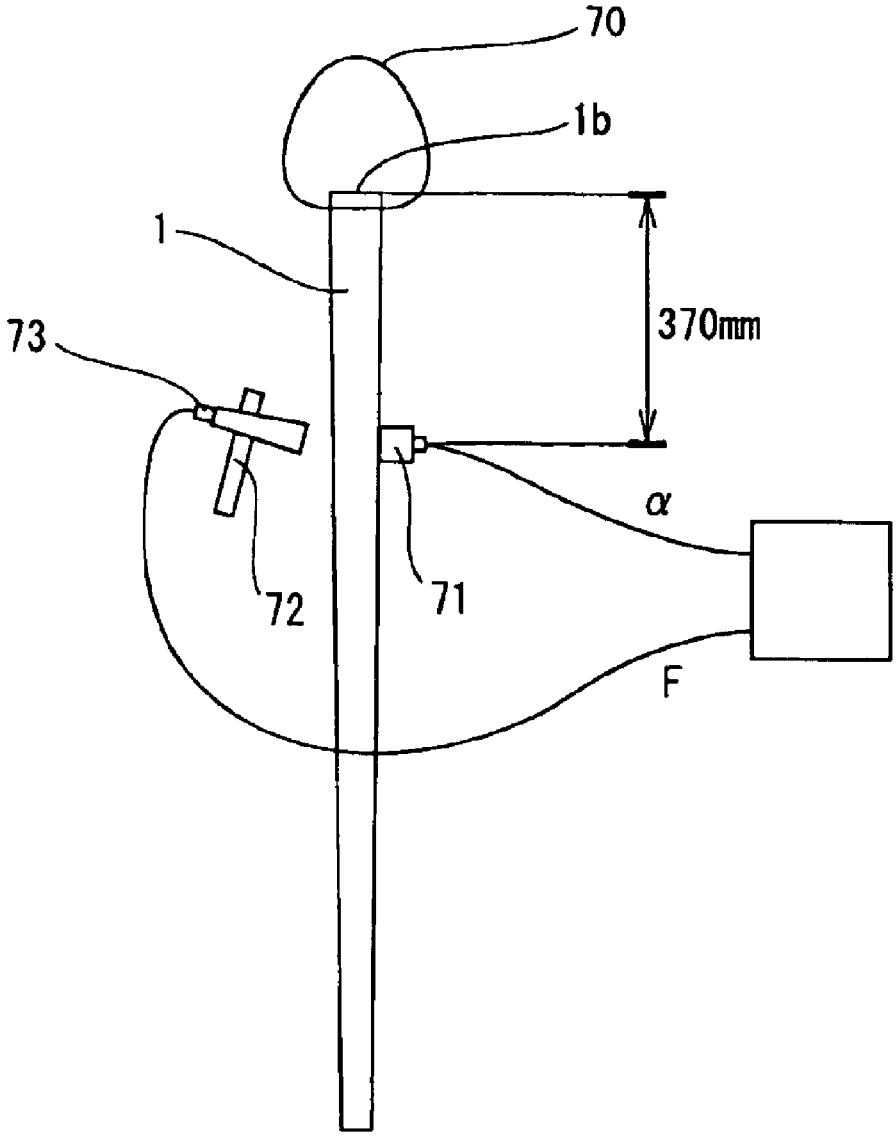
FIG. 10 shows a method of measuring a vibration-damping factor.

As shown in FIG. 10, a grip end 1*b* of a shaft 1 was hung with a string 70, and an acceleration pick-up meter 71 was installed on the shaft 1 at a position 370 mm apart from the grip end 1*b*. The side of the shaft 1 opposite to the side on which the acceleration pick-up meter 71 was installed was hit with an impact hammer 72 to vibrate the shaft 1. An input vibration F was measured with a force pink-up meter installed on the impact hammer 72, and a response vibration a was measured with the acceleration pick-up meter 71 to compute the vibration-damping factor (vibration-damping performance) of the shaft 1. The results are shown in Table 1.

Measurement of Flight Distance

Feeling Test

A ball-hitting test was conducted by using 50 players. A sensual evaluation of whether vibrations or shocks were felt on their hands after hitting golf balls was made. Shafts which gave the least vibration and shock to the players, and thus best feeling to them, was marked as ◎. Shafts which gave a good feeling to them, was marked as ○. Shafts which did not give a good feeling to them, was marked as Δ. Shafts which gave much vibration and shock to them, and thus a bad feeling to them, was marked as X. An evaluation that obtained numbers from the 50 players was adopted.

Durability Test

A head was installed on each shaft so that a swing robot manufactured by Miyamae Kabushiki Kaisha hits golf balls at a head speed of 51 m/s. Shafts which were not broken after hitting 3000 or more golf balls were marked by "○", whereas those broken after hitting 3000 or more golf balls were marked by "X".

As shown in the Table 1, in the golf club shaft of each of Examples 1–6, the thermoplastic FRP had a vibration-damping factor not less than 1.0. The thermoplastic FRP of each shaft had a weight within the specified range. Thus the vibration-damping factors of the shafts were as high as 0.8 or more. Further, it could be confirmed that they had very favorable results in the feeling test and durability test.

On the other hand, in the golf club shaft of Comparison Example 1, the vibration-damping factor of the thermoplastic FRP was as low as 0.7. Therefore, the shaft had a low vibration-damping performance and gave a bad feeling to the players. In the golf club shaft of Comparison Example 2, the weight of the thermoplastic FRP was small. Thus, the shaft performed poorly in the evaluation of the vibration-damping performance and in the feeling test. In the shaft of Comparison Example 3, the weight of the thermoplastic FRP was large. Thus it was excellent in the vibration-damping performance and in the feeling test, but was inferior in the durability test.

As apparent from the foregoing description, according to the present invention, the shaft is the lamination of the weight-specified fiber reinforced thermoplastic resinous material having the vibration-damping factor of not less than 1.0 and the fiber reinforced thermosetting resinous material. Therefore, the shaft is lightweight and capable of keeping the balance between a high strength of the fiber reinforced thermosetting resinous material and a high vibration-damping performance of the vibration-damping factor-specified fiber reinforced thermoplastic resinous material. That is, utilizing the advantage of the fiber reinforced thermosetting resinous material and that of the fiber reinforced thermoplastic resinous material, it is possible to allow the shaft to be lightweight and have a high strength and rigidity to give a favorable feeling to a player when the player hits a golf ball with a golf club composed of the shaft. That is, the shaft 1 is capable of suppressing vibrations and impacts to be transmitted to the player when the player hits the golf ball with the golf club composed of the shaft.

What is claimed is:

1. A golf club shaft having a fiber reinforced thermosetting resinous material and a fiber reinforced thermoplastic resinous material, wherein said fiber reinforced thermoplastic resinous material having a vibration-damping factor not less than 1.0 has a weight not less than 10% nor more than 60% of a weight of said golf club shaft, and the fiber reinforced thermoplastic resinous material is disposed only in the range covering 30% of the whole length of the shaft from its tip.

2. The golf club shaft according to claim 1, wherein said golf club shaft is pipe-shaped and has a hollow portion; and said fiber reinforced thermoplastic resinous material is disposed on a part of a peripheral surface of said golf club shaft, on an inner peripheral surface thereof or between layers of said fiber reinforced thermosetting resinous material.

3. The golf club shaft according to claim 1, wherein the vibration-damping factor of the fiber reinforced thermoplastic resinous material is not more than 2.

4. The golf club shaft according to claim 1, wherein the weight of the fiber reinforced thermoplastic resinous material is not less than 15% nor more than 40%.

5. The golf club shaft according to claim 1, wherein the fiber reinforced thermosetting resinous material is a prepreg, and a lamination of a plurality of said prepregs are molded in the shape of a pipe; and wherein the fiber reinforced thermoplastic resinous material is molded into the shape of a pipe or a pair of semicylindrical pipes, and said pipe or pair of semicylindrical pipes made of the fiber reinforced thermoplastic resinous material is bonded to the outer or inner surface of said pipe made of said fiber reinforced thermosetting resinous material.

6. The golf club shaft according to claim 1, wherein the fiber reinforced thermoplastic resinous material is formed as a prepreg, disposed as a layer between prepregs made of said fiber reinforced thermosetting resinous material, and molded as a laminate into the shape of the shaft.

7. The golf club shaft according to claim 6, wherein said fiber reinforced thermosetting resinous material comprising carbon fibers having a tensile modulus of elasticity of 10–80 ton f/mm$^2$.

8. The golf club shaft according to claim 1, wherein the fiber reinforced thermoplastic resinous material is disposed in the shaft entirely or partly in the longitudinal direction of the shaft.

9. The golf club shaft according to claim 1, wherein a thickness of the fiber reinforced thermoplastic resinous material is not less than 0.3 mm nor more than 0.6 mm.

10. The golf club shaft according to claim 1, wherein said fiber reinforced thermosetting resinous material comprising carbon fibers having a tensile modulus of elasticity of 10–80 ton f/mm$^2$.

11. The golf club shaft according to claim 1, wherein said fiber reinforced thermosetting resinous material is a laminate of a prepeg, wherein said prepeg has reinforcing fibers having a tensile modulus of elasticity of 40 ton f/mm$^2$ and an orientation angle of −45° or +45°.

* * * * *